United States Patent [19]

Boissevain

[11] Patent Number: 4,543,737

[45] Date of Patent: Oct. 1, 1985

[54] SYSTEM FOR DISTRIBUTING STEAM ON A PAPER WEB

[75] Inventor: Mathew Boissevain, Los Altos Hills, Calif.

[73] Assignee: Measurex Corporation, Cupertino, Calif.

[21] Appl. No.: 589,609

[22] Filed: Mar. 14, 1984

[51] Int. Cl.[4] ..... F26B 13/30; F26B 13/00

[52] U.S. Cl. ..... 34/92; 34/155

[58] Field of Search ..... 34/92, 16, 155

[56] References Cited

U.S. PATENT DOCUMENTS

| | | | |
|---|---|---|---|
| 185,742 | 12/1876 | Gillespie | 34/16 |
| 2,192,168 | 3/1940 | Bell | 34/16 |
| 4,253,247 | 3/1981 | Bergstrom | 34/155 |

*Primary Examiner*—John J. Camby

*Attorney, Agent, or Firm*—Hal Bohner

[57] ABSTRACT

The specification discloses a steam distributor having a chamber to contain steam on one side of a paper web and a vacuum box on the opposite side of the paper web. The chamber has a vacuum release means to prevent the chamber from being pulled onto the paper web if vacuum is applied when steam is not applied.

7 Claims, 5 Drawing Figures

SYSTEM FOR DISTRIBUTING STEAM ON A PAPER WEB

BACKGROUND OF THE INVENTION

1. The Field of the Invention

This invention relates to means for distributing steam on a moving sheet of paper.

2. State of the Art

In most paper products it is desirable to automatically control the cross machine moisture content using a steam shower or steam distributor. Most paper machines have continuous moisture scanners which read the sheet moisture content across the machine as the paper is manufactured. The information from this continuous measurement can be fed into a controlling computer and the steam flow in the steam distributor can be automatically controlled according to this information.

One type of steam distributor is taught in U.S. Pat. No. 4,253,247. The patent teaches a multi-chambered steam hood with means of steam distribution to each chamber provided by a steam distributor. Steam flows from the steam distributor through ports into a nozzle and into each chamber. The steam flow is controlled by raising or lowering a control plug.

A vacuum box is located on the side of the paper opposite the steam hood so that a vacuum can be applied to pull steam through the paper. The vacuum is normally applied only when steam is introduced into the steam distributor. If, however, due to mechanical failure or operator error the steam flow is stopped while vacuum continues to be applied, sufficient sunction could be produced to pull the distributor onto the moving web of paper. This could result in damage to the paper and to the Fourdrinier wire.

OBJECT OF THE INVENTION

An object of the present invention is to provide a steam distribution system with vacuum release means to prevent the distributor from being pulled onto the paper web by vacuum.

Further objects and advantages of the invention can be ascertained by reference to the specification and drawings which are provided by way of example and not in limitation of the invention, which is defined by the claims and equivalents.

DETAILED DESCRIPTION OF THE PREFERRED EMBODIMENTS

Figure 1:
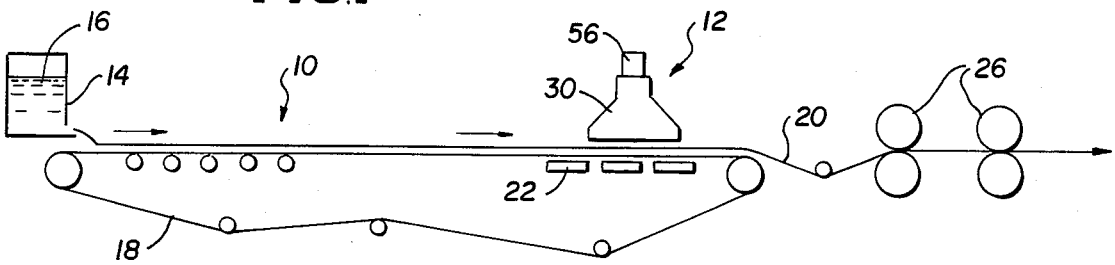
FIG. 1 is a schematic view of a paper making machine including a steam distributor.

There is shown in FIG. 1 a paper making machine 10 including a hot gas distributor 12. In practice steam is normally used; however in some applications other hot gases could be substituted. Herein the word steam will be used to mean steam or such other hot gas. The machine shown is of the Fourdrinier type and includes a pulp box 14 feeding pulp mixture 16 to a web-like conveyor 18 on which the liquid is drawn from the pulp to leave a paper web 20, which travels partially dried under the distributor 20 and over vacuum box 22, a press section 26, further dryers (not shown) and a known moisture measuring device (not shown) which measures the moisture content across the sheet. The distributor is adjusted manually or automatically to reduce the moisture variations in the cross direction.

Figure 2:
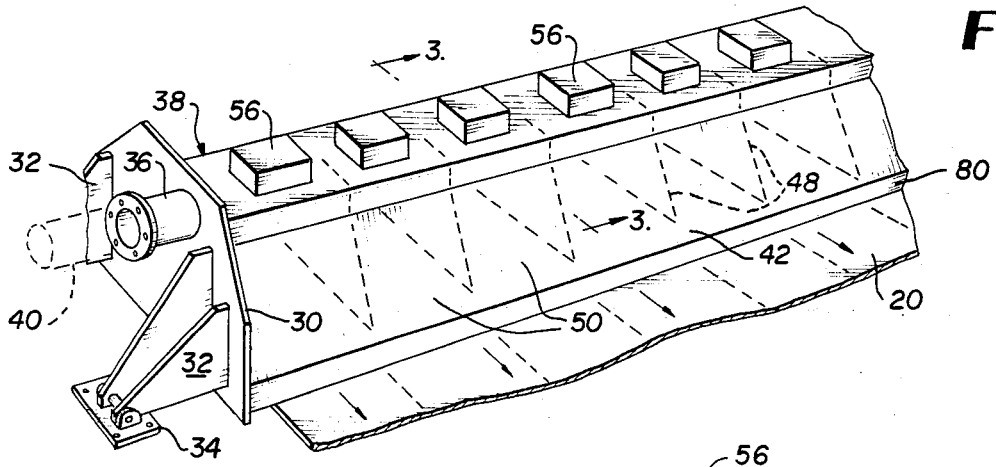
FIG. 2 is an isometric illustration of a present embodiment.

As shown in FIG. 2 the steam distributor 12 includes a hood 38 having end plates 30 at each end, each supported by a pair of legs 32 carried by feet 34 mounted on the conveyor frame (not shown) outside the path of the conveyor. A pipe 36 is supported by the end plates 30. A steam pipe 40 supplies a hot gas, in the present instance, steam from a suitable source to the pipe 36. The hood 38 includes outer shell 42, an inner shell 44 and insulation 46 which together form side walls 47 and 49. Transverse partitions 48 divide the hood into a plurality of chambers or compartments 50 spanning the entire width of the web 20. Tubes 52, individual to the compartments having ports 51 each supplies steam to its compartment in accordance with the setting of a pneumatic valve 56 individual to that chamber and controlled by the moisture profile measuring device or manually. The steam travels through the pipe 36, through ports 51 into the tubular nozzles 52, through the nozzles into the chambers 50, through slotted, arcuate diffusing plates 60, through the web 20 and a supporting screen or vacuum box cover 62 forming the top of a vacuum box 22. The diffusion plates may be drilled plates of different patterns. The plates may be omitted to leave an open bottom chamber.

Details of the valves 56 are not taught herein and can be ascertained from U.S. Pat. No. 4,253,247, discussed above. Other known types of valves are also suitable.

Figure 3:
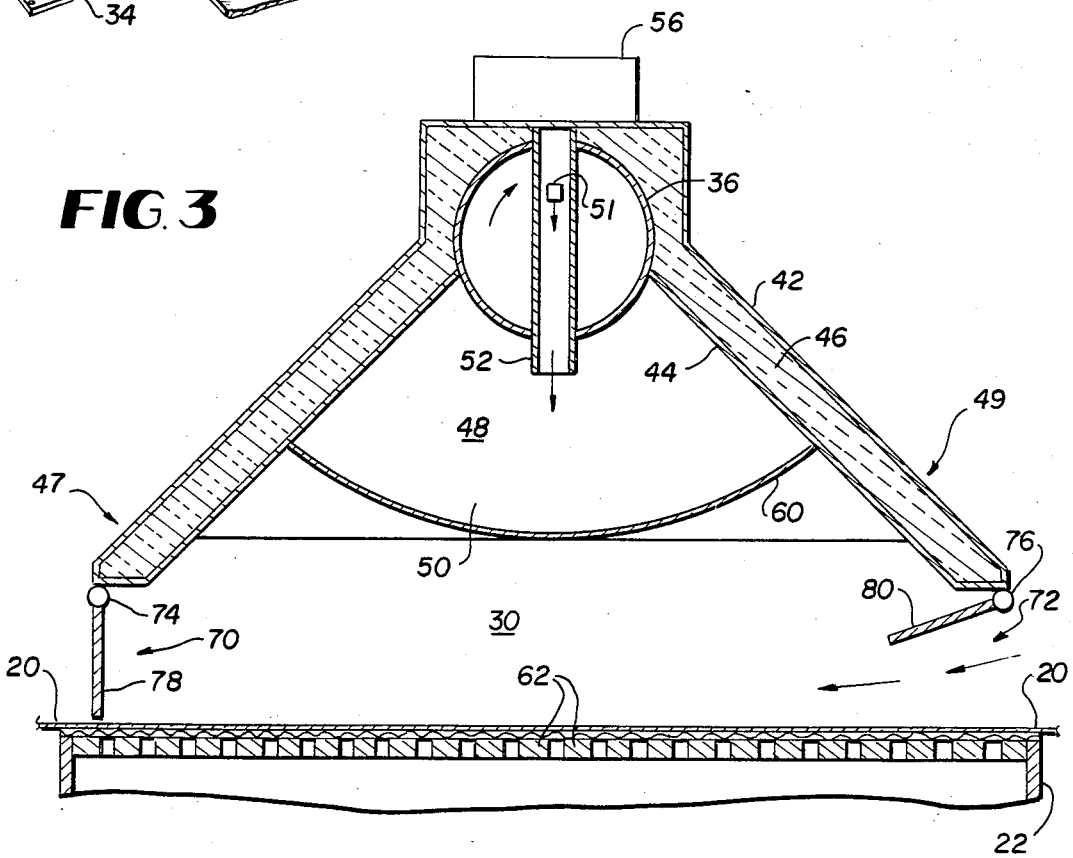
FIG. 3 is a cross sectional illustration of a present embodiment.

Turning to FIG. 3, there is shown an embodiment of the invention including vacuum release means formed in the sidewalls 47 and 49. The sidewalls 47 and 49 of the chamber 50 are spaced apart from paper web 20 so that spaces 70 and 72 are formed therebetween. In practice, we have found it desirable to space the sidewalls 47 and 49 about four inches above the paper web 20. Hinges 74 and 76 are mounted along the bottoms of side walls 47 and 49 and plates 78 and 80 are affixed one to each hinge. The plates are of sufficient height to extend from the hinges to about three quarter inch above the paper web 20.

Figure 4:
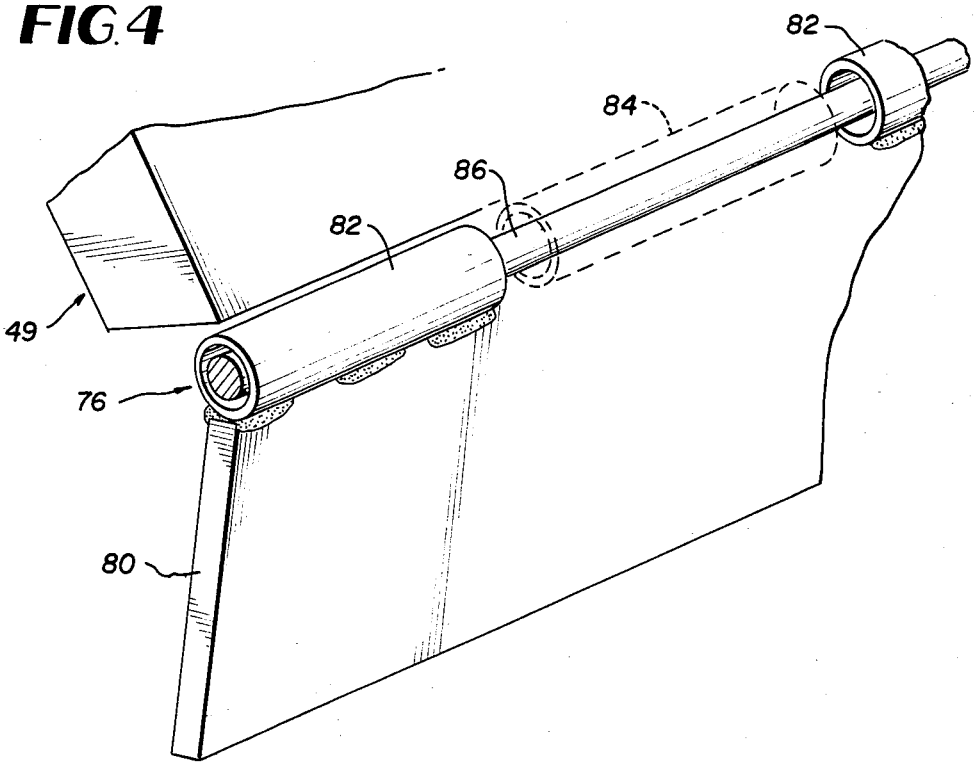
FIG. 4 is a detail of part of the embodiment shown in FIG. 3.

FIG. 4 shows further details of the hinge 76, which is substantially the same as hinge 74. The hinge 76 includes a plurality of cylinders 82 welded to the plate 80 and a plurality of similar cylinders 84 welded to the sidewall 49. The cylinders 82 are spaced apart from one another and the cylinders 84 are located between them. Also, the cylinders 82 and 84 are slightly spaced apart from one another. A rod 86 is inserted through the cylinders 82 and 84 to form the pivot member.

In operation, steam is introduced into the hood 38 and vacuum is applied to the vacuum box 22 so that the pressure in the hood is near ambient. In this case the plates 78 and 80 are vertical as indicated by plate 78 in FIG. 3 so that no substantial quantity of steam escapes to the atmosphere and no substantial quantities of ambient air enters the hood. However, if through operator error or mechanical failure steam is not introduced through pipe 36 while vacuum is applied to the box 64, ambient air is drawn into the hood as indicated by the arrows, and the plate is opened by the air flow as shown by plate 80. Thus the vacuum does not exert downward force on the hood 38. It should be understood that the downward force on the hood 38 could be extreme, if not for the present invention. For example, for a hood 60 inches in width and 300 inches in length 90,000 pounds of force would be exerted by a vacuum of five pounds per square inch, which is not uncommon.

In some applications it could be necessary to have only one plate 78 or 80 rather than both plates. In such a case sidewall 47 or 49 would extend downward to near the paper mat 20. However, in practice I have found it generally desirable to utilize two plates which will move slightly to accommodate high spots in the paper mat thus insuring that the mat will not build up against a sidewall.

Figure 5:
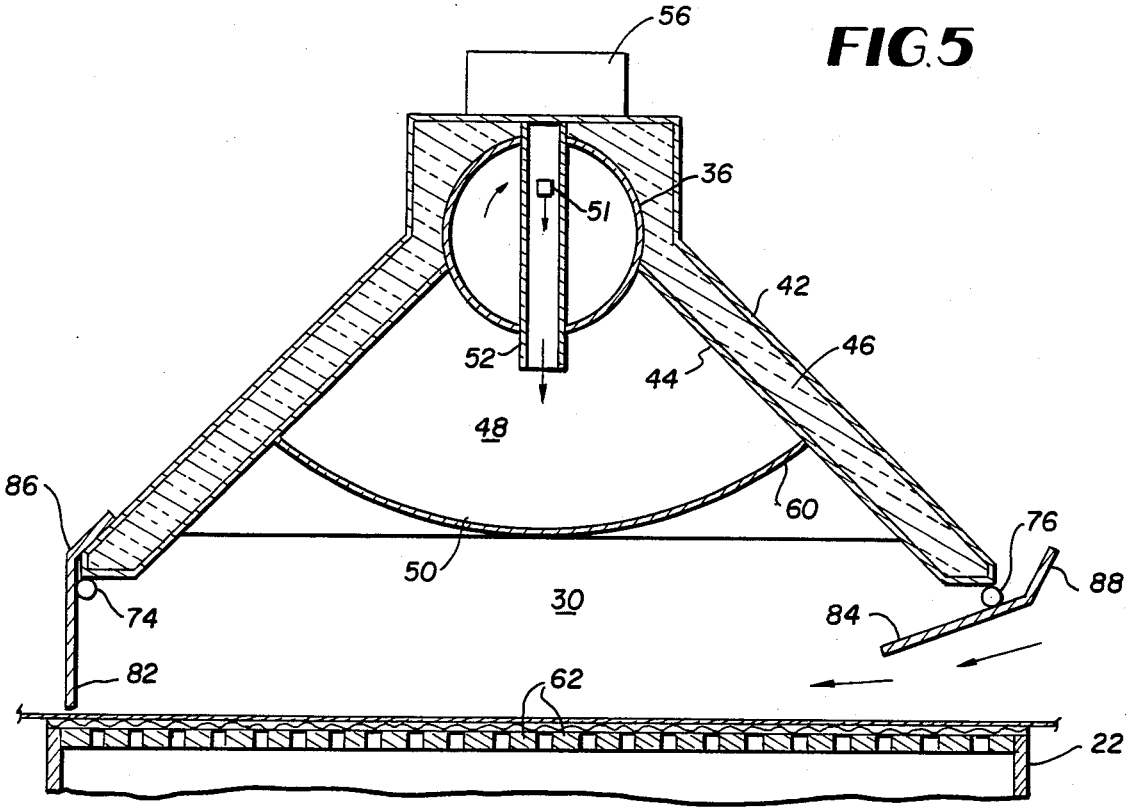
FIG. 5 is a cross sectional illustration of another embodiment.

FIG. 5 illustrates another embodiment in which plates 82 and 84 are similar to plates 78 and 80. However, plates 82 and 84 have upper portions 86 and 88 which extend above the hinges 74 and 76. The upper portions 86 and 88 are constructed to conform to the lower parts of sidewalls 47 and 49 and to prevent the lower parts of the plates from swinging outwardly. Thus the plates 82 and 84 prevent the escape of substantial quantities of steam even if the steam pressure becomes high in the hood.

I claim:

1. A system for distributing steam on a paper web, the system comprising:

(a) a hood located to one side of the paper web;

(b) means to introduce steam into the hood;

(c) vacuum box means located to the side of the web opposite said hood to apply a vacuum to the web;

(d) vacuum release means coupled to said hood to:

(i) provide a space between the paper web and the vacuum release means, the space having a predetermined first height to restrict the flow of air into said hood when steam is being introduced to said hood; and (ii) provide a space between the paper web and the vacuum release means, the space having a height greater than the predetermined first height to permit a substantial flow of air to enter said hood when vacuum is applied to said vacuum box means while steam is not being introduced into said hood.

2. A system according to claim 1 wherein said hood has two side walls and two end walls, and said vacuum release means is coupled to at least one of said side walls.

3. A system according to claim 2 wherein, (a) said hood further includes at least one diffusing plate;

(b) said means to introduce steam into said hood is coupled to said hood on the side of said diffusing plate opposite the paper web;

(c) said vacuum release means is coupled to said hood on the side of said diffusing plates opposite said steam introduction means.

4. A system according to claim 2 wherein said hood is spaced apart from the paper web to form a space therebetween and said vacuum release means includes a plate coupled by a hinge to one of said side walls, said plate being constructed and arranged so that the plate substantially closes the space when steam is introduced into said hood.

5. A system according to claim 4 wherein said plate is constructed and arranged so that when steam is not being introduced into said hood and vacuum is applied to said vacuum box means the vacuum causes said plate to substantially uncover the space.

6. A system according to claim 4 further including a stop member coupled to said plate to prevent said plate from uncovering the space under conditions of high steam pressure.

7. A system according to claim 1 wherein the predetermined first height is about 0.75 inch.

* * * * *